US008002131B2

(12) United States Patent
Karabin

(10) Patent No.: US 8,002,131 B2
(45) Date of Patent: Aug. 23, 2011

(54) CHAMBERED BOTTLE STOPPER

(76) Inventor: Walter Karabin, King City (CA)

( * ) Notice: Subject to any disclaimer, the term of this patent is extended or adjusted under 35 U.S.C. 154(b) by 1043 days.

(21) Appl. No.: 11/774,062

(22) Filed: Jul. 6, 2007

(65) Prior Publication Data

US 2009/0008355 A1 Jan. 8, 2009

(51) Int. Cl.
*B65D 39/00* (2006.01)

(52) U.S. Cl. ..... 215/299; 215/295; 215/305; 81/3.15; 40/311

(58) Field of Classification Search ..... 215/399, 215/396, 228, 299–302, 397, 296; 220/763, 220/212.5, 521; 40/311; 81/3.15
See application file for complete search history.

(56) References Cited

U.S. PATENT DOCUMENTS 559,079 A * 4/1896 Howson ..... 215/299
3,581,927 A * 6/1971 Langdon ..... 215/228
4,098,417 A * 7/1978 Bennett ..... 215/204
4,106,656 A * 8/1978 Babiol ..... 215/364
5,056,681 A * 10/1991 Howes ..... 220/522
5,622,208 A * 4/1997 Vinson ..... 138/89

* cited by examiner

*Primary Examiner* — Robin Hylton

(74) *Attorney, Agent, or Firm* — Cahn & Samuels, LLP

(57) ABSTRACT

A stopper apparatus for closing wine bottles and like receptacles having an elongated stopper body of flexible material adapted for insertion into the neck of the bottle so as to create a water-tight and air-tight seal between the media contained within said bottle and the outside environment. The stopper body has a generally cylindrical shape with a slight taper near the base of the cylinder and features a cavity near the top of the cylinder. The cavity features a concealed apparatus therein. At least one self revealing handle is attached to the stopper body for extracting said stopper from the neck of the bottle, wherein extracting said stopper body from the neck of said bottle exposes said concealed apparatus contained therein.

2 Claims, 5 Drawing Sheets

CHAMBERED BOTTLE STOPPER

I. FIELD OF THE INVENTION

This invention relates in general to the field of bottle stoppers and more particularly to an apparatus for sealing wine bottles and like receptacles to create a high integrity seal between the media contained within the bottle and the outside environment.

II. BACKGROUND

The wine making process is very involved. Great care is taken to ensure that the process is hygienic. These processes follow food grade standards. All equipment is sterilized to prevent contamination. The product is protected from contact with other gases and liquids which will contaminate the product and spoil the wine.

Once wine is ready for packaging or bottling the product is transferred from a barrel or vat into individual containers, vessels or bottles that are practical for transport or consumption by commercial or retail purchasers. The containers must be sealed to prevent the wine from escaping or from air entering the bottle. Exposure to oxygen will cause wine to degrade, and prolonged exposure will eventually ruin the wine rendering it unfit for human consumption.

The primary concerns of the wine industry is sealing the vessel to prevent the wine from encountering oxygen post bottling using practical, cost effective measures, and maintaining consumer interest in their product. It is very important to seal the vessel hermetically. There are two prevailing methods of sealing vessels one of which is using a cylindrical shaped stopper, and the other is to use a screw top stopper. Both have positive and negative aspects.

For the purposes of this document a stopper is anything preventing the passage of any fluid through or around its static position.

Generally stopper material is cork, plastic, composite or metal depending on the application and the needs of the wine producer.

Wine producers and their marketers currently have limited marketing options when differentiating between the varieties of wine available. There are clear and colored bottles with a variety of shapes and designs. Some bottles have an obscure form. Some bottle necks are typical while others are sleek and contemporary in shape. Typically stoppers are used to create a high integrity seal between the media contained within the bottle and the outside environment.

There is a selection of stopper styles ranging from cork and composite cork stoppers to stoppers made from plastics or metals such as aluminum. The cork and plastic stoppers are sometimes branded or heat embossed to label the surface since printing is not easily accomplished. FIG. 1 illustrates a traditional stopper with a heat embossed label. Surface printing in single color or multiple colors process on cork stoppers is generally not attempted, since the ink used is generally not food grade. Even if food grade ink is used, there exist concerns of possible negative health effects as well the negative effect on the chemistry of the wine. Thus, marketers are limited to the outside of the containment vessel for the most practical means of delivering their message. The most widely used method of marketing material is bottle labeling. Labels are the most popular form of marketing in that they allow for an inexpensive versatile and effective means of delivering a specific branding or marketing message.

III. SUMMARY OF INVENTION

It is an object of at least one embodiment of the present invention to provide a stopper apparatus for creating a high integrity seal between the media contained within the bottle and the outside environment.

It is an object of at least one embodiment of the present invention to provide a stopper apparatus that delivers a flexible marketing package to the wine consumer at the time of uncorking.

It is an object of at least one embodiment of the present invention to provide a stopper apparatus that delivers marketing package to the wine consumer at the time of uncorking without resorting to printing or imprinting a message on the wine cork.

It is an object of at least one embodiment of the present invention to provide a stopper apparatus for sealing wine bottles and like receptacles featuring self revealing extraction handles.

It is an object of at least one embodiment of the present invention to provide an inexpensive means for delivering a marketing package to the wine consumer at the time of uncorking.

It is an object of at least one embodiment of the present invention to provide a means for delivering a marketing package to the wine consumer at the time of uncorking without degrading the taste of the wine.

It is an object of at least one embodiment of the present invention to provide a stopper apparatus that is re-useable.

It is an object of at least one embodiment of the present invention to provide a stopper apparatus that can be removed without the aid of a traditional cork screw.

It is an object of at least one embodiment of the present invention to provide a stopper apparatus that can be removed without the aid of a removal tool.

It is an object of at least one embodiment of the present invention to provide a stopper apparatus that can commercially exploit the ritual of uncorking a wine bottle.

It is an object of at least one embodiment of the present invention to provide a stopper apparatus that commercially exploits the momentary interest in the wine cork immediately after uncorking a bottle of wine.

One embodiment the current invention features a stopper apparatus for sealing wine bottles and like receptacles featuring an elongated stopper body of flexible material adapted for insertion into the neck of the bottle so as to seal the bottle. A stopper body having a slight taper near the base of the cylinder; and a compartment disposed near the top of said stopper apparatus, said compartment being configured to accommodate a concealed item.

In another embodiment, the current invention features a stopper apparatus for closing wine bottles and like receptacles featuring an elongated stopper body of flexible material adapted for insertion into the neck of the bottle to create a water-tight and air-tight seal between the media contained within the bottle and the outside environment. The stopper body has a generally cylindrical shape with a slight taper near the base of the cylinder and features a cavity near the top of the cylinder. The cavity features a concealed apparatus therein. The at least one self revealing handle is attached to the stopper body for extracting the stopper from the neck of the bottle. Extracting the stopper body from the neck of the bottle exposes the concealed apparatus contained in the stopper cavity.

In yet another embodiment, the invention features a stopper means for sealing wine bottles and like receptacles featuring an elongated stopper body of flexible material adapted for insertion into the neck of the bottle to create water-tight and air-tight seals between the media contained within the bottle and the outside environment. The stopper body has a cylindrical shape with a slight taper near the base of the cylinder and features a chamber disposed near the top of the stopper body. The chamber contains some type of concealed marketing means. At least one concealable stopper extraction means is attached to the stopper body. The stopper extraction means being self revealing and operable for extracting the stopper from the neck of the bottle. Extracting the stopper means from the neck of the bottle exposes the concealed marketing means.

As used herein "substantially", "generally", and other words of degree, are used as a relative modifier intended to indicate permissible variation from the characteristic so modified. It is not intended to be limited to the absolute value or characteristic which it modifies but rather approaching or approximating such a physical or functional characteristic.

IV. DESCRIPTION OF THE DRAWINGS

In the accompanying drawings which form part of the specification and wherein like numerals and letters refer to like parts wherever they occur:

DETAILED DESCRIPTION

Figure 1:
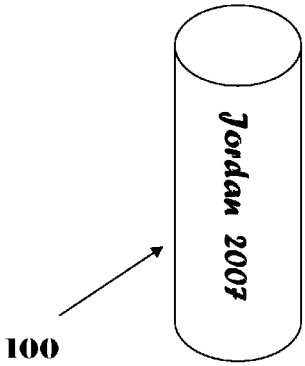
FIG. 1 illustrates a traditional stopper apparatus.
Figure 2:
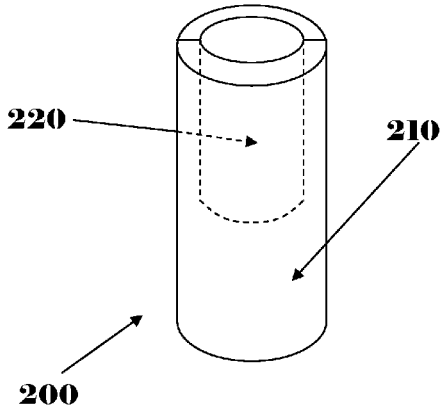
FIG. 2 illustrates an exemplary embodiment of the stopper apparatus of the current invention featuring a cavity therein.

Referring now to the figures where like reference numbers denote like parts FIG. 2 shows an example embodiment of the stopper apparatus of the current invention featuring a cavity therein. The stopper apparatus 200 features and elongated stopper body 210 of flexible material adapted for insertion into the neck of the bottle so as to seal the bottle neck.

The stopper body 210 has a slight taper near the base of the cylinder. The shape of the stopper is adapted to seal the neck portion of the particular bottle, thus the stopper shape may vary as the shape of the neck of the bottle but maintains a generally cylindrical shape.

Figure 2A:
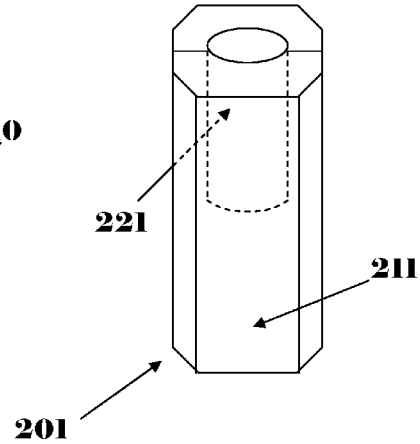
FIG. 2A illustrates an exemplary embodiment of the stopper apparatus of the current invention having a generally cylindrical shaped body featuring a cavity therein.

FIG. 2A illustrates an example embodiment featuring a variation of the cylindrical shaped body. Stopper apparatus 201 features an elongated stopper body 211 with multiple sides, but generally maintains a cylindrical shape. Stopper body 211 is also constructed of a flexible material with a slight taper near the base.

Referring again to the example embodiment illustrated in FIG. 2, stopper apparatus 200 is inserted into the neck portion a bottle (not shown) and creates a water-tight and air-tight seal between the media contained within the bottle and the outside environment. The stopper body 210 may be constructed of cork, a cork composite, plastic or a combination thereof.

Stopper apparatus 200 features a compartment, cavity or chamber 220 disposed near the top of the stopper body 210. The compartment 220 is configured to accommodate a concealed item therein. Compartment 220 may be secured by the structure of the stopper apparatus in the form of a hinge means or other structural member, a wine wrapper, or label deployed at the top of the bottle to conceal the compartment 220. A wax or plastic seal may be used to secure the compartment 220 when the stopper apparatus 200 is inserted into the bottle or vessel.

In another example embodiment the compartment 220 may be secured by a transparent material, to allow a consumer to see into the compartment 220 when the stopper assembly 200 is installed in the bottle, but unable to access the item therein without removing the stopper assembly 200 from the bottle.

Figure 3:
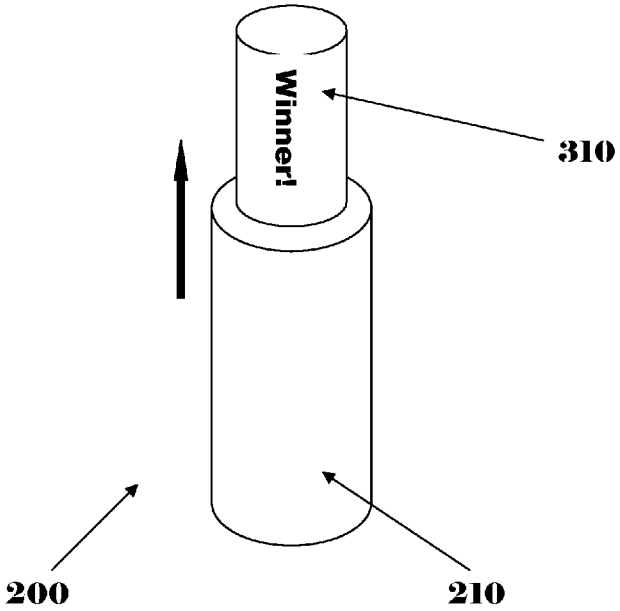
FIG. 3 illustrates an exemplary embodiment of the stopper apparatus of the current invention with a marketing package exposed.

The extraction of the stopper assembly 200 from the neck of the bottle exposes the contents of the compartment 220. FIG. 3 illustrates an exemplary embodiment of the stopper apparatus 200 of the present invention with marketing means exposed. In this particular example embodiment the marketing means is a marketing package 310 in the form of a prize notification. The compartment 220 may contain a media package, a message, a gift item or other marketing means. The marketing means can be anything from coupons, to gifts, recorded music, slogans, a particular sent or any media designed to appeal to one of the senses, sight, sound, touch, taste or smell.

In yet another example embodiment the compartment 220 may contain a sensor package apparatus including a thermometer to indicate the highest temperature the wine has been exposed to after bottling, or any other apparatus that meets the needs of the manufacturer or bottler, and size constraints of the compartment. The content of compartment 220 is not a limiting feature of the present invention.

Incorporation of the chamber 220 into the stopper body has an additional benefit of imparting additional flexibility in the upper portion of the stopper body 210. The additional flexibility has an added benefit of easing the extraction of the stopper assembly 200 from the bottle, if a consumer opts to use a "tong type" stopper extraction tool.

Figure 4:
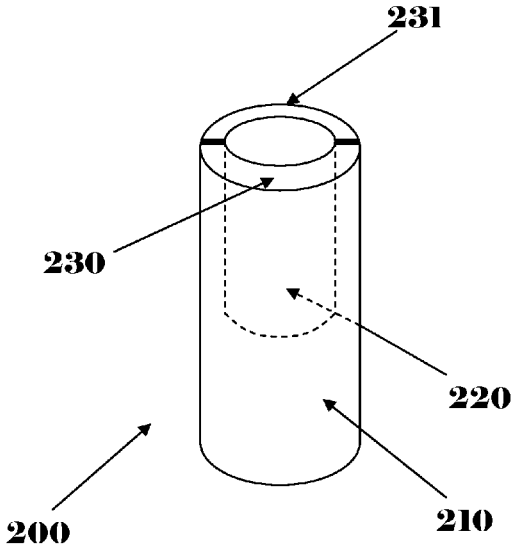
FIG. 4 illustrates an exemplary embodiment of the stopper apparatus of the current invention with the self revealing handles concealed.
Figure 5:
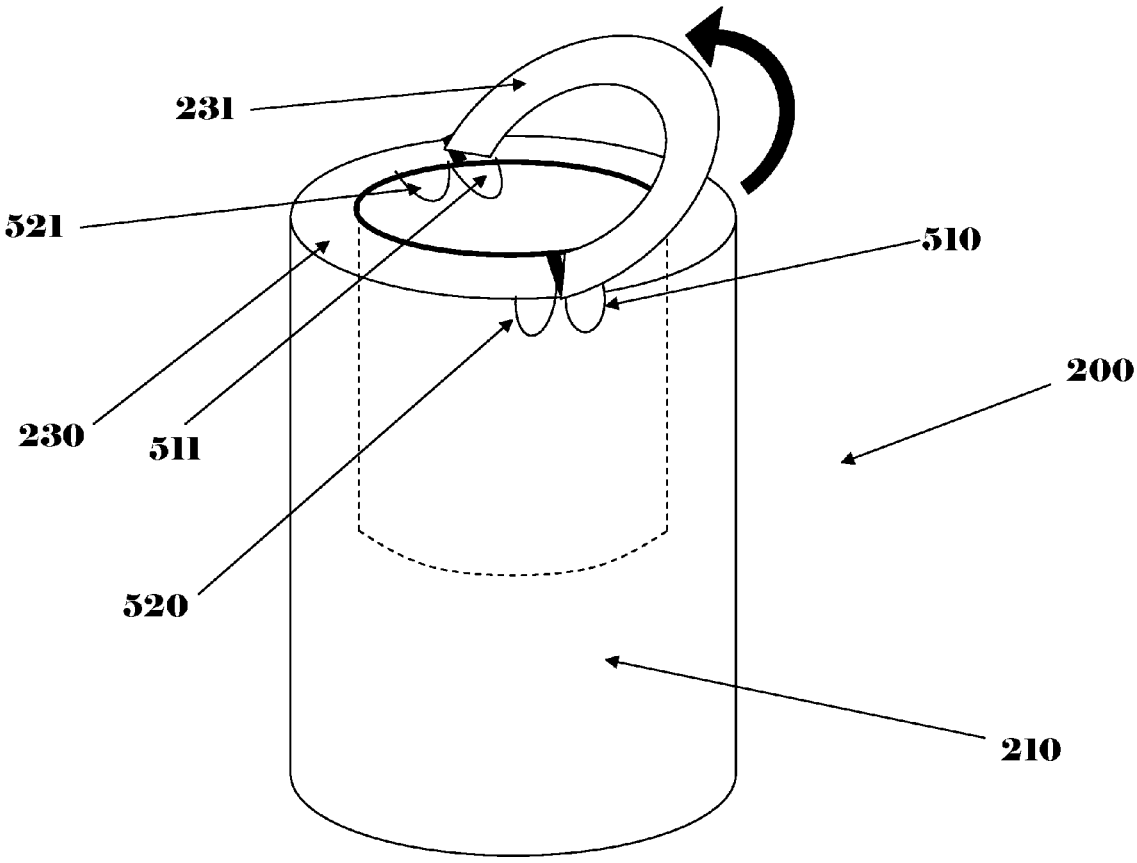
FIG. 5 illustrates an exemplary embodiment of the stopper apparatus of the current invention with one of the self revealing handles concealed and a self revealing handle partially raised.

Referring now to FIG. 4 and FIG. 5 with continued reference to FIG. 2, FIG. 4 illustrates an exemplary embodiment of the stopper apparatus of the current invention with at least one self revealing handle 230, 231. The stopper 200 features self revealing handles 230, 231 that lay flat in the inserted position and rotate around hinge means 510, 511, 520, 521 to reveal themselves allowing a consumer to use the handles 230, 231 to extract the stopper apparatus 200 from the bottle.

FIG. 5 illustrates an exemplary embodiment of the stopper apparatus 200 of the current invention with one of the self revealing handles 230, concealed and a self revealing handle 231 in a partially raised position. Hinge means 510, 511, 520, 521 can be any means of attaching the handle 230, 231 to the stopper body 210 that allows the handle 230, 231 to rotate from a concealed or streamlined position when the cork is inserted into the bottle, or stored, to a position that allows access to handles 230, 231 providing leverage so that the stopper assembly 200 can be removed from the bottle by use of the handle 230, 231. The hinge means 510, 511, 520, 521 can be in the form of a hinge, a pin, or flexible molded structure attached to, or part of the stopper body 210.

Figure 6:
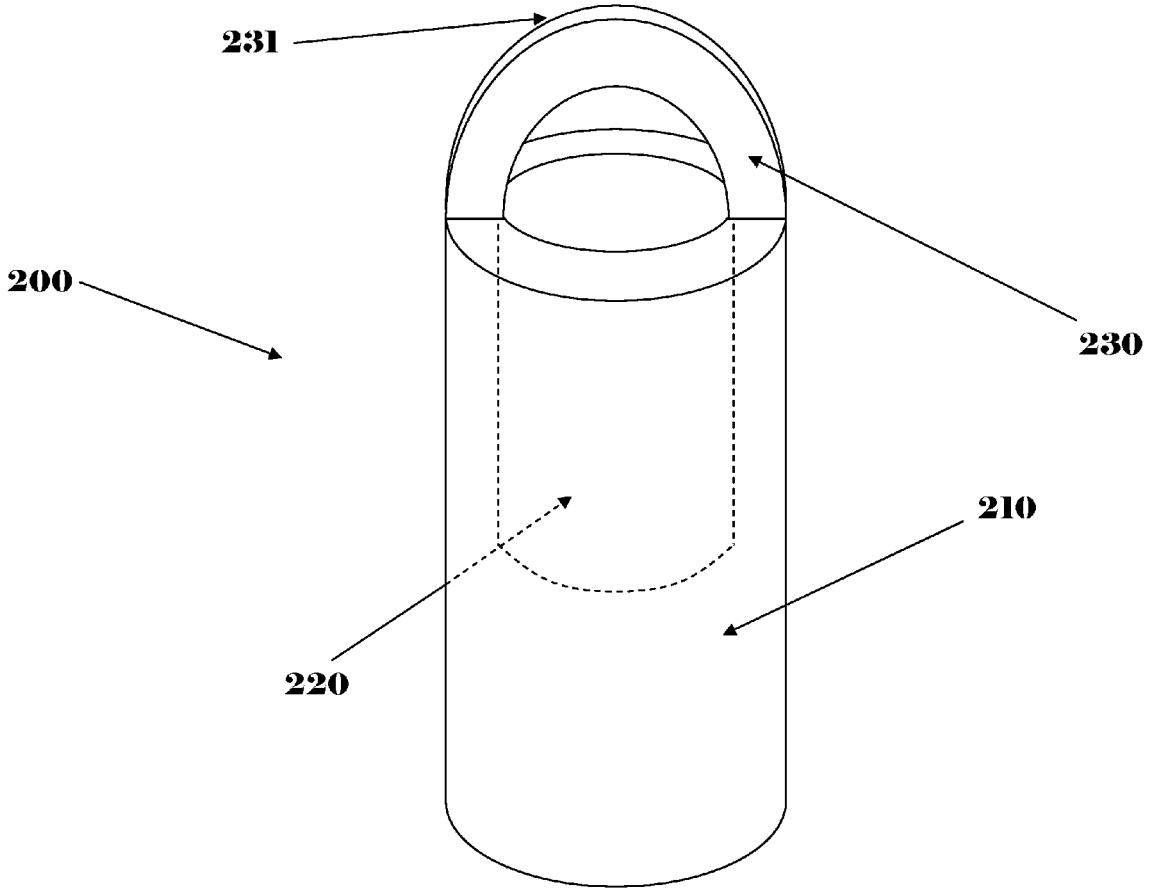
FIG. 6 illustrates an exemplary embodiment of the stopper apparatus of the current invention with two self revealing handles in the up position.

In yet another example embodiment the at least one self revealing handle lays flat in the inserted position and rotates up to 90 degrees around each hinge means. FIG. 6 illustrates the example embodiment of the stopper apparatus of FIG. 5 with two self revealing handles 230, 231 in the fully extended position. With continued reference to FIG. 4 and FIG. 5, handles, 230, 231 rotate from a concealed or streamlined position when the stopper apparatus 200 is inserted into the bottle FIG. 4 by hinge means 510, 511, shown in FIG. 5 to the fully extended position as illustrated in FIG. 6. In addition the self revealing handles may be configured to conceal or secure the item contained in compartment 220.

When in the fully extended position, handles 230, 231 provide a mutually supporting structure that allowing the handles 230, 231 to provide sufficient leverage for one to extract the stopper apparatus 200 from the bottle by use of the handles 230, 231. A user may also use an improvised tool, for example a metal key or the handle of an eating utensil, inserted through the loop created by the extended handles to aid in removal of the stopper assembly 200.

The extraction means may be in the form of handles as disclosed in the above example embodiment, or any structural element attached to the stopper body 210 that allows a consumer to extract the stopper assembly 200 from the bottle.

Figure 7:
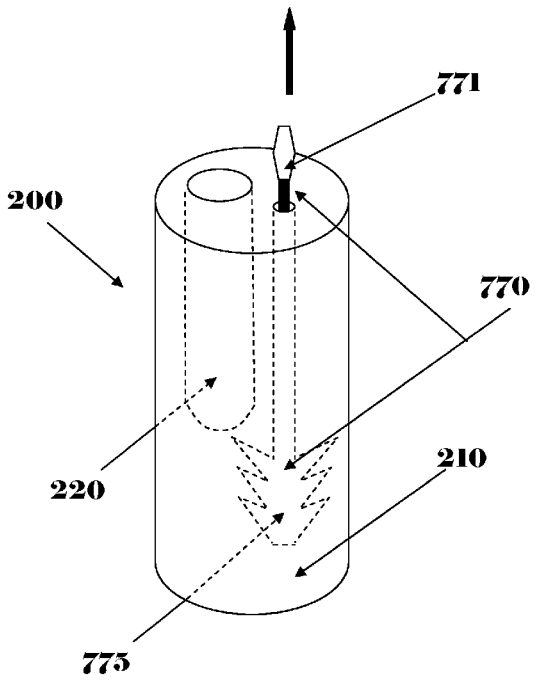
FIG. 7 illustrates an exemplary embodiment of the stopper apparatus with an integral extraction assembly incorporated into the stopper body.

In yet another example embodiment the extraction means is in the form of an extraction assembly coupled to the stopper body. Referring now to FIG. 7, which illustrates the stopper assembly 200 with an integral extraction assembly 770, stopper body 210 features an extraction assembly having a handle 771 coupled to a structural member 775 incorporated into the stopper body 210. The structural member 775 is contained within the stopper body 210 and is anchored to the stopper body 210 such that a consumer may extract the stopper assembly 200 from the bottle by firmly pulling the handle 771. The stopper assembly 200 shown in FIG. 7 also features a compartment 220 that is offset from the centerline of the stopper body 210. This feature provides sufficient thickness and strength in the portion of the stopper body 210 supporting the structural member 775 to allow extraction of the stopper assembly via the extraction assembly with little or no fragmenting.

Figure 8:
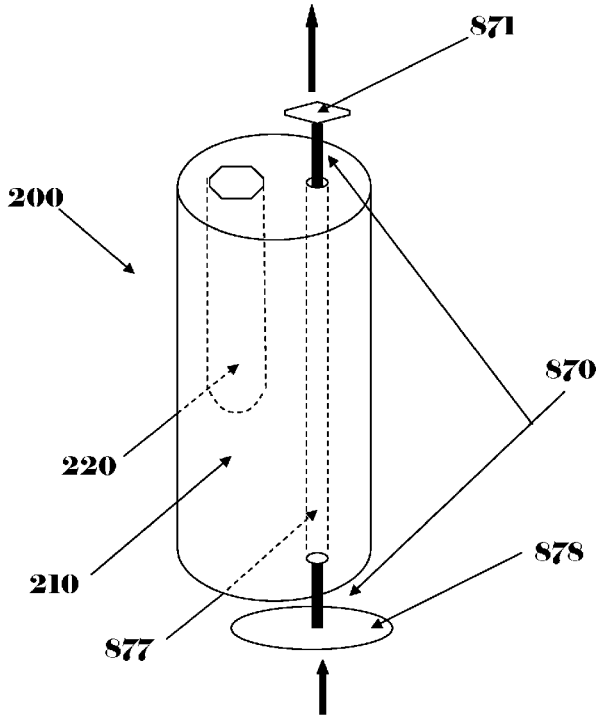
FIG. 8 illustrates an exemplary embodiment of the stopper apparatus with an integral extraction assembly passing through the stopper body.

Referring now to FIG. 8, which illustrates yet another example embodiment of the stopper assembly with an integral extraction assembly, stopper body 210 features an extraction assembly 870 having a handle 871 disposed at the top of the stopper body 210 coupled to a structural member 878 underneath the stopper body 210. The extraction assembly 870 passes through the stopper body 210 via a passage 877 that extends the length of the stopper body 210. The extraction assembly 870 features a substantially rigid structural member 878 that is considerably larger in diameter than the passage 877 through which the handle 871 and the structural member 881 are attached. This allows the structural member to function as an anchor coupling the stopper body 210 to the handle 871 and allowing the stopper assembly 200 to be extracted from the bottle by pulling the handle 871. In this example embodiment the passage 877 and stopper assembly is sealed by wax or some other sealant to provide seal integrity when inserted into the bottle or vessel.

The stopper assembly 200 shown in FIG. 8 also features a compartment 220 that is offset from the extraction assembly 870. This feature provides sufficient thickness and strength in the portion of the stopper body 200 to support the extraction assembly 870 and facilitate successful extraction.

In another example embodiment the invention features a stopper apparatus 200 for closing wine bottles and like receptacles featuring an elongated stopper body 210 of flexible material adapted for insertion into the neck of the bottle so as to create a water-tight and air-tight seal between the media contained within the bottle and the outside environment. The stopper body 220 has a generally cylindrical shape with a slight taper near the base of the cylinder features a cavity 220 near the top of the stopper body. The cavity 220 contains a concealed apparatus therein. The stopper body 200 also features at least one self revealing handle 230, 231 coupled to the stopper body for extracting the stopper from the neck of the bottle. Extracting the stopper body from the neck of the bottle exposes the concealed apparatus contained therein.

The at least one self revealing handle 230, 231 lays flat in the inserted position and rotates around hinge means 510, 511 to reveal itself and allow use of the at least one handle 231 to extract the stopper from the neck of the bottle.

In yet another example embodiment the invention features a stopper means for sealing wine bottles and like receptacles having an elongated stopper body of flexible material adapted for insertion into the neck of the bottle to create water-tight and air-tight seals between the media contained within the bottle and the outside environment.

The stopper body features a cylindrical shape with a slight taper near the base of the cylinder and has a chamber disposed near the top of the stopper body, the chamber containing concealed marketing means.

The stopper body also features at least one concealable stopper extraction means coupled to the stopper body, the stopper extraction means being self revealing and operable for extracting the stopper from the neck of the bottle. Extracting the stopper means from the neck of the bottle exposes the concealed marketing means.

Given the foregoing, it should be apparent that the specific described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

The invention claimed is:

1. A stopper means for sealing wine bottles comprising:

an elongated stopper body of flexible material adapted for insertion into the neck of the bottle to create water-tight and air-tight seals between media contained within said bottle and the outside environment;

said elongated stopper body having a top, base and substantially cylindrical shape with a slight taper near the base of the cylinder;

a chamber disposed near the top of said elongated stopper body, said chamber containing concealed marketing means;

a structural element securing said chamber;

at least one concealable stopper extraction means coupled to said elongated stopper body, said stopper extraction means being operable for extracting said stopper from the neck of said bottle;

wherein extracting said stopper means from the neck of said bottle displaces said structural element exposing said concealed marketing means and wherein said stopper body further comprises a passage extending from the top of said stopper body to the base of said stopper body; and said concealable stopper extraction means further comprises an integral extraction assembly, said extraction assembly having a handle disposed on top of the stopper body, said handle being coupled to a structural member disposed beneath the stopper body adjacent to the base through said passage, said structural member having a diameter greater than the diameter of said passage.

2. The stopper means of claim 1 wherein said chamber is offset from said extraction assembly.

* * * * *